US012036597B2

(12) United States Patent
Kumagai et al.

(10) Patent No.: US 12,036,597 B2
(45) Date of Patent: Jul. 16, 2024

(54) JIG FOR METAL PLASTIC WORKING

(71) Applicant: Toyo Seikan Group Holdings, Ltd., Tokyo (JP)

(72) Inventors: Takuho Kumagai, Yokohama (JP); Tomohiro Ogawa, Yokohama (JP); Ryozo Shiroishi, Yokohama (JP); Naoya Matsumoto, Yokohama (JP); Masahiro Shimamura, Yokohama (JP)

(73) Assignee: TOYO SEIKAN GROUP HOLDINGS, LTD., Tokyo (JP)

( * ) Notice: Subject to any disclaimer, the term of this patent is extended or adjusted under 35 U.S.C. 154(b) by 571 days.

(21) Appl. No.: 17/286,171

(22) PCT Filed: Oct. 16, 2019

(86) PCT No.: PCT/JP2019/040690
§ 371 (c)(1),
(2) Date: Apr. 16, 2021

(87) PCT Pub. No.: WO2020/090475
PCT Pub. Date: May 7, 2020

(65) Prior Publication Data

US 2021/0354186 A1 Nov. 18, 2021

(30) Foreign Application Priority Data

Oct. 31, 2018 (JP) ..... 2018-204936

(51) Int. Cl.
*B21D 22/28* (2006.01)

(52) U.S. Cl.
CPC ..... *B21D 22/28* (2013.01)

(58) Field of Classification Search
CPC ..... B21D 22/08; B21D 22/286; B21D 22/283
See application file for complete search history.

(56) References Cited

U.S. PATENT DOCUMENTS 5,921,131 A 7/1999 Stange
2004/0083786 A1* 5/2004 Garnett ..... B21D 22/26 72/348
2018/0229287 A1 8/2018 Kumagai et al.
(Continued)

FOREIGN PATENT DOCUMENTS

CN 108290200 A 7/2018
EP 2444245 A1 4/2012
(Continued)

OTHER PUBLICATIONS

Office Action dated Sep. 15, 2022, issued in Chinese Application No. 201980071482.0.
(Continued)

*Primary Examiner* — Debra M Sullivan
(74) *Attorney, Agent, or Firm* — Sughrue Mion, PLLC

(57) ABSTRACT

A jig for metal plastic working for use in plastic working of a metal or alloy workpiece, in which a working surface is moved relative to the workpiece in contact with the workpiece. The working surface of the jig is smoothed so that an arithmetic mean surface roughness Ra is not more than 0.12 μm, and so that no protrusion is observed that has a width of not less than 200 μm and a height of not less than 10 μm, which are calculated on a basis of a projection thereof along a working direction.

4 Claims, 4 Drawing Sheets

(56) References Cited

U.S. PATENT DOCUMENTS

| | | | |
|---|---|---|---|
| 2018/0318900 | A1 | 11/2018 | Shiroishi et al. |
| 2020/0071017 | A1 | 3/2020 | Hirota et al. |
| 2021/0069767 | A1 | 3/2021 | Kumagai et al. |

FOREIGN PATENT DOCUMENTS

| | | | | |
|---|---|---|---|---|
| EP | 3287544 | A1 | 2/2018 | |
| JP | 06-304679 | A | 11/1994 | |
| JP | 2783746 | B2 | 8/1998 | |
| JP | 10-249462 | A | 9/1998 | |
| JP | 4984263 | B2 | 7/2012 | |
| JP | 5152836 | B2 | 2/2013 | |
| JP | 2018-069256 | A | 5/2018 | |
| WO | 2011/125657 | A1 | 10/2011 | |
| WO | 2017/033791 | A1 | 3/2017 | |
| WO | WO-2018079434 | A1 * | 5/2018 | ..... B21D 22/20 |

OTHER PUBLICATIONS

Extended European Search Report dated Jul. 6, 2022 in Application No. 19878984.4.
International Search Report of PCT/JP2019/040690 dated Dec. 24, 2019 [PCT/ISA/210].

* cited by examiner

WORKING DIRECTION

IRONING
SURFACE PRESSURE HIGH
29
31
19
D
27

DRAWING
SURFACE PRESSURE LOW
23
25
13
21
19

PUNCHING
11
15
17
11
13

JIG FOR METAL PLASTIC WORKING

CROSS REFERENCE TO RELATED APPLICATIONS

This application is a National Stage of International Application No. PCT/JP2019/040690 filed on Oct. 16, 2019, claiming priority based on Japanese Patent Application No. 2018-204936 filed on Oct. 31, 2018.

TECHNICAL FIELD

The present invention relates to a jig for metal plastic working for use in plastic working of metals.

BACKGROUND ART

Conventionally known plastic working of metals include: rolling, bending, sharing, drawing, ironing and the like. Such plastic working is carried out by bringing a jig made of a rigid base material of cemented carbide, for example, into contact with a metal as a workpiece.

When plastic working as mentioned above is carried out, a lubricant agent such as oil is usually used to avoid direct contact between the workpiece and the working jig. However, in the case of plastic working such as ironing that is carried out under high surface pressure, a lubricating film cannot be locally maintained, which allows the workpiece and the working jig to be brought into direct contact with each other, resulting in seizure of the workpiece to a working surface. Consequently, a molded product may have a rough surface. Further, in a case where a sintered body such as cemented carbide is used as the working jig, fine voids necessarily present in the sintered body are exposed even on a mirror-finished surface of the cemented carbide. If plastic working of a soft metal such as aluminum is carried out by using a jig having such voids on its surface, abrasion powder of the soft metal is disadvantageously adhered and deposited (build-up) on the working surface. The seizure as well as the adhesion and deposition as mentioned above not only result in a rough surface of a molded product but also reduce the tool life significantly by a change in dimension and the like due to progressive abrasion and regrinding of the surface of the working jig.

In view of the above, it has been widely known to provide the working surface of the jig for use in plastic working of metals with a hard film mainly for the purpose or ensuring abrasion resistance, seizure resistance and the like (see, for example, Patent documents 1 and 2).

The hard film formed on the working surface of the rigid base material needs to have a certain level of smooth surface. In Patent documents 1 and 2 as well as Patent documents 3 and 4, the surface is adjusted so that the arithmetic mean surface roughness Ra, the maximum height roughness Rmax, and the size and number of irregularities are within certain ranges.

However, depending on the method of plastic working, there are some cases where the jig can be used effectively even when the requirements for the roughness and the size and number of irregularities on the surface of the hard film as mentioned above are not met. On the other hand, even when the adjustment is made to meet the requirements, a resultant product may have linear flaws on its surface.

PRIOR ART DOCUMENTS

Patent Documents

Patent Document 1: JP 2783746 B
Patent Document 2: WO 2017/033791 A1

Patent Document 3: JP 1984263 B
Patent Document 4: JP 5152836 B

SUMMARY OF THE INVENTION

Problems to be Solved by the Invention

Therefore, an object of the present invention is to provide a jig for metal plastic working for use in plastic working of a metal or alloy workpiece, the jig enabling plastic working to be carried out without forming linear flaws on a surface of a molded product.

Means for Solving the Problems

As a result of conducting a study on linear flaws formed on a surface of a product to be obtained by metal plastic working, the present inventors have found out the following knowledge to complete the present invention. That is, during plastic working in which a working surface of a working jig is moved relative to a workpiece in contact with the workpiece, linear flaws are formed along a working direction by protrusions present on the working surface of the working jig. The formation of linear flaws can be avoided effectively by adjusting the positions of irregularities of a certain size which are inevitably present on the working surface.

The present invention provides a jig for metal plastic working for use in plastic working of a metal or alloy workpiece, in which a working surface is moved relative to the workpiece in contact with the workpiece. The working surface of the jig is smoothed so that an arithmetic mean surface roughness Ra is not more than 0.12 μm, and so that no protrusion is observed that has a width of not less than 200 μm and a height of not less than 10 μm, which are calculated on the basis of its projection along a working direction.

It is preferable for the jig for metal plastic working of the present invention that:

(1) the working surface is coated with a surface treatment film;
(2) the surface treatment film is a carbon film;
(3) the surface treatment film is a polycrystalline diamond film;
(4) the jig has a ring shape with an inner annular surface serving as the working surface; and
(5) the jig is used for ironing.

Effects of the Invention

According to the present invention, the jig for metal plastic working is used for plastic working in which a working surface of the jig is moved relatively in contact with a metal or alloy workpiece. Examples of the plastic working include drawing, ironing, and wire drawing. The working surface is smoothed to have an arithmetic mean surface roughness Ba of not more than 0.12 μm thereby preventing a resultant product from having a rough surface. Further, the smoothing is carried out so that no protrusion is observed that has a width of not less than 200 μm and a height of not less than 10 μm, which are calculated on the basis of its projection along a working direction.

Namely, the working surface is smoothed so that the width and height of a protrusion are not more than the certain values, which are calculated on the basis of its projection along the working direction. Therefore, it is possible to effectively prevent flaws that extend linearly along the working direction from being formed on the surface of a product.

The jig for metal plastic working of the present invention is used preferably as a die for tough ironing that is applied to a relatively soft metal or alloy such as aluminum or an aluminum alloy. The jig of the present invention is used most preferably to obtain a molded can body made of a metal or an alloy.

MODE FOR CARRYING OUT THE INVENTION

A jig for metal plastic working of the present invention is used for plastic working in which a working surface of the jig is moved relatively in contact with a metal or alloy workpiece. The working surface is smoothed to meet certain conditions.

The first condition is as follows: the working surface, i.e., the surface to be brought into contact with the workpiece, needs to have a surface roughness Ra (JIS B-0601-1994) of not more than 0.12 μm, particularly not more than 0.8 μm. The surface roughness Ra represents a so-called arithmetic mean roughness. When the working surface is smoothed so that the surface roughness Ra is within this range, sliding properties between the working surface and a surface of the workpiece (workpiece surface) are ensured during plastic working, thereby effectively avoiding roughness of a surface of a resulting product (product surface).

Meanwhile, it is impossible to effectively suppress the formation of flaws with a large line width that extend linearly along a working direction only by smoothing the working surface so that the surface roughness Ra is not more than the certain value as described above.

Figure 1:
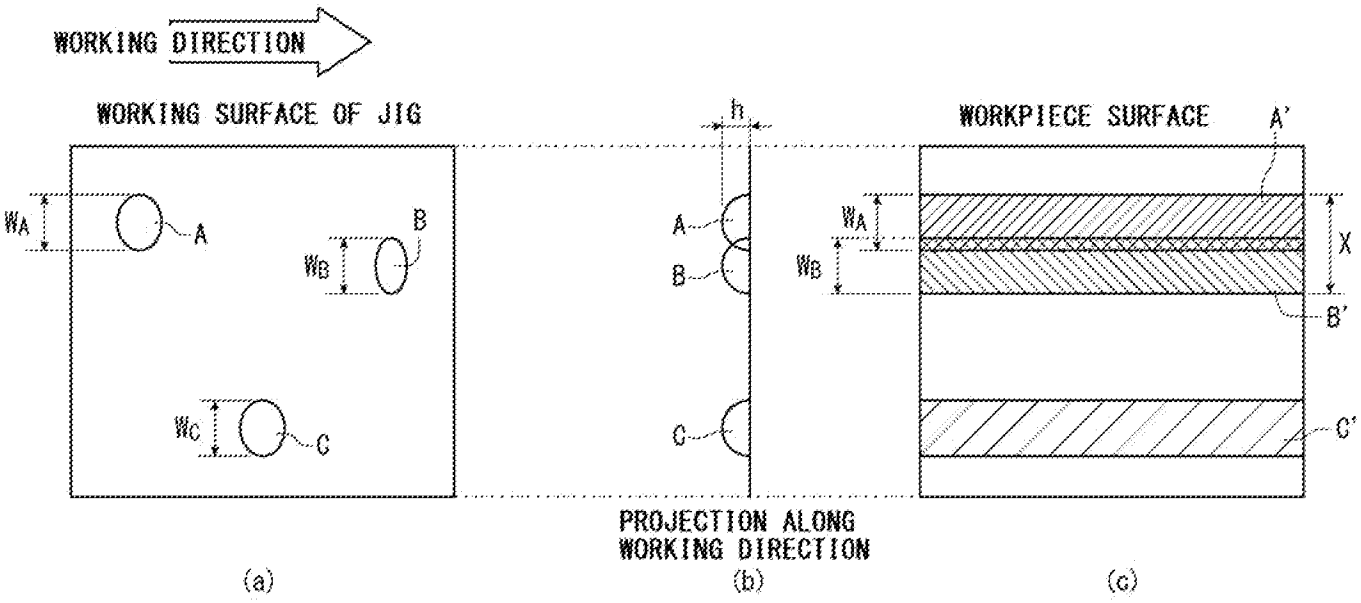
FIG. 1 is a diagram for explaining the principle of the present invention.

A description will be given with reference to FIG. 1, in which (a) is a plan view of the working surface of the jig; (b) shows a projection on a surface along the working direction; and (c) is a plan view of the surface of the workpiece (workpiece surface) after working. As shown in FIG. 1, the working surface of the jig have three protrusions A, B and C having widths $W_A$, $W_B$ and $W_C$, respectively. As can be understood in (c) in FIG. 1, the protrusion B is present in the path of the protrusion A in the working direction, while the protrusion C is present away from the path of the protrusion A in the working direction.

Thus, the protrusions on the working surface of the jig may be projected on a surface along the working direction as shown in (b) in FIG. 1. Projections of the protrusion A and the protrusion B are seen as overlapping, with each other, so that a resultant width X is larger than each of the width $W_A$ of the protrusion A and the width $W_B$ of the protrusion B, while the projection width of the protrusion C remains equal to the width $W_C$.

Namely, during plastic working using the jig that has the protrusions A to C on its working surface as described above, when the working surface is moved relatively in contact with the workpiece surface of the workpiece, a linear flaw A' having the line width $W_A$, a linear flaw B' having the line width $W_B$, and a linear flaw C' having the line width We are formed along the working direction corresponding to the projections of the protrusions A, B and C, respectively, as shown in (c) in FIG. 1. Each of the widths of the linear flaws A', B' and C' is within a range that poses no quality problem. In this case, due to the overlapping projections of the protrusions A and B, the linear flaw A' and the linear flaw B' formed corresponding to the protrusions A and B, respectively, result in the formation of a linear flaw having the line width X which is larger than each of the widths $W_A$ and $W_B$.

As can be understood from the description above, in a case where a plurality of protrusions present on the working surface of the jig are close to each other (i.e., in a case where a flaw is present in the path of another protrusion in the working direction), a linear flaw having a width larger than that of each of the protrusions is formed on the workpiece surface. That is, even if an adjustment has been made to reduce the width of each of the protrusions, the linear flaw having the line width X larger than the width of each of the protrusions is formed on the workpiece surface if the projections of the protrusions overlap each other. As a result, a product to be obtained by plastic working has impaired appearance.

With the foregoing in mind, in the present invention the working surface of the jig is smoothed so that there is no protrusion having a certain width, which is calculated on the basis of its projection along the working direction, and specifically so that there is no protrusion in the path of another protrusion in the working direction. More specifically, in the present invention, the working surface of the jig is smoothed so that no protrusion is observed that has a width of not less than 200 μm, preferably not less than 160 μm, which is calculated on the basis of its projection along the working direction.

Further, it is also important in the present invention that the working surface be smoothed so that no protrusion is observed that has a height h (see, (b) in FIG. 1) of not less than 1 μm, particularly not less than 10 μm, which is calculated on the projection basis as mentioned above. That is, even if the width of the protrusion which is observed on the projection basis has been adjusted to be not more than the certain value as described above, the presence of a protrusion having a large height h results in the formation of a deep flaw on the workpiece surface. As a result, a product to be obtained by plastic working has impaired appearance. Considering that the oil film thickness varies depending on the lubricated condition during working, it is difficult to uniquely determine the height of the protrusion. In view of the fact that a flaw having a depth of 1 μm or more on a workpiece is visually noticeable, a protrusion of not less than 1 μm becomes a problem on the assumption that working is carried out without using any lubricant agents. After due consideration, the present inventors have found as shown in Example 1 to be described below that a height of 10 μm may serve as a reference under a lubricated condition in the prior art.

Figure 2:
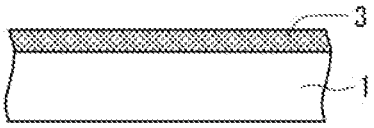
FIG. 2 is a schematic side cross-sectional view showing principal parts of a jig for metal plastic working of the present invention.

The material for the jig for metal plastic working of the present invention is not limited particularly as long as the working surface is smoothed so as to meet the above-described conditions. Considering that the workpiece is of metal or alloy and that the jig is applied to tough plastic working in which the working surface is moved relatively in contact with the workpiece surface, it is usually preferable that the jig includes a rigid base material 1 and a; surface treatment film 3 provided on the surface of the rigid base material 1 as shown in the schematic view of FIG. 2. The working surface smoothed as described above is present on the surface of the surface treatment film 3.

The rigid base material 1 is not limited particularly, and is preferably made of a material that has enough rigidity to stand tough plastic working and enough heat resistance to stand film formation. Typical examples of the material having both rigidity and heat resistance include: so-called cemented carbide obtained by sintering a mixture of tungsten carbide (WC) and a metal binder such as cobalt; cermet obtained by sintering a mixture of metal carbide such as titanium carbide (TiC) or a titanium compound such as titanium carbonitride (TiCN) and a metal binder such as nickel or cobalt; and hard ceramics such as silicon carbide (SiC), silicon nitride ($Si_3N_4$), alumina ($Al_2O_3$), and zirconia ($ZrO_2$).

The surface treatment film 3 is selected suitably in accordance with the intended effect, and the material therefor is not limited. For example, the surface treatment film 3 may be formed of any of various kinds of metallic oxides and the like. When an emphasis is placed on abrasion resistance and seizure resistance to provide a jig for plastic working of soft metals, a hard film of Tic, TiN, TiAlN, CrN, DLC or the like is usually preferable. Among them, a carbon film containing diamond crystals, such as a DLC film or a polycrystalline diamond film, is particularly preferable.

Preferably, the carbon film (i.e., the surface treatment film 3) in the present invention has an intensity ratio in a range of 0.5 to 5.0, particularly 0.8 to 3.0. The intensity ratio is represented by the following Formula (1):

$$I_D/I_C \quad (1)$$

where $I_D$ is the maximum peak intensity at 1333±10 $cm^{-1}$ in the Raman optical spectrum of the surface of the carbon film 3; and $I_C$ is the maximum peak intensity at 1500±100 $cm^{-1}$ in the Raman optical spectrum of the surface of the carbon film 3.

Figure 3:
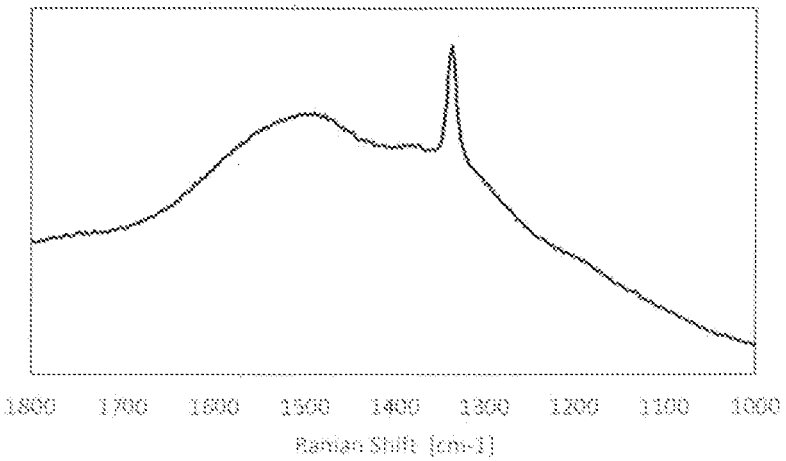
FIG. 3 is a diagram showing an example of the Raman optical spectrum of a surface of a carbon film.

A description will be given with reference to FIG. 3 which shows the Raman optical spectrum of the carbon film formed in the examples to be described below. The maximum peak intensity $I_D$ at 1333±10 $cm^{-1}$ is derived from diamond components in the film, while the maximum peak intensity Is at 1500±100 $cm^{-1}$ is derived from graphite components in the film. Accordingly, a smaller peak intensity ratio indicates that the film contains a larger amount or graphite, while a larger peak intensity ratio indicates that the film is closer to diamond crystals. As can be understood from this, the carbon film of the present invention preferably contains graphite components so as to meet the aforementioned intensity ratio, thereby ensuring excellent rigidity and adhesion to the underlying rigid base material 1 and exhibiting favorable impact resistance. For example, even after repeated tough plastic working, the film is effectively prevented from peeling off, so that the working jig can be expected to have a longer life.

The above-described carbon film is formed on the surface of the rigid base material 1 by a well-known hot filament CVD method or a well-known plasma CVD method such as microwave plasma CVD, high-frequency plasma CVD, or thermal plasma CVD, followed by surface grinding.

The formation of the film usually uses, as a source gas, a gas obtained by diluting a hydrocarbon gas such as methane, ethane, propane, or acetylene to about 1% with a hydrogen gas. The source gas may be suitably mixed with a small amount of gas such as oxygen, carbon monoxide, or carbon dioxide for the purpose of adjusting the film quality and the film formation rate.

The film is formed in the following manner. By the use of the aforementioned source gas, the rigid base material 1 is heated to a high temperature in a range of 700° C. to 1000° C., so that plasma is generated by microwave power, high-frequency power, or the like. The source gas is decomposed in the plasma to generate active species, and diamond crystals are allowed to grow on the rigid base material 1. During the film formation, graphite and amorphous carbon produced on the rigid base material 1 are etched selectively by hydrogen atoms dissociated in the plasma. This allows the film to contain a large amount of diamond components, resulting in the Raman optical spectrum peak intensity ratio within the aforementioned range.

Although the foregoing description has been directed to the method of forming the carbon film, the surface treatment film 3 made of another inorganic oxide material can be also formed on the surface of the rigid base material 1 in the same manner as above by using a conventionally known method such as CVD or PVD.

The surface treatment film as described above, particularly the film formed by using CVD, tends to have a rough surface because selective etching is performed as required to enhance crystal growth during the film formation. Thus, in order to use this film for the jig for plastic working, the thus-formed film needs to be subjected to a grinding treatment for smoothing.

The surface of the surface treatment film 3 can be grinded by a well-known method.

Examples of the grinding method include: mechanical grinding using a grinding stone such as diamond abrasive grains; grinding using a chemical action; and a combination of the mechanical grinding and the chemical grinding. By performing any of these grinding methods, the arithmetic mean surface roughness Ra of the film can be adjusted within the above-described range.

In the present invention, it is necessary that at least the working surface be smoothed so that there is no protrusion having a width and a height larger than the predetermined ranges, which are calculated on the basis of its projection along the working direction.

In a case where conventional grinding processing is performed for smoothing, there are necessarily some protrusions having a width and a height larger than the predetermined values, which are calculated on the projection basis. This is because, although the surface as a whole is grinded to be smoothed, resulting in a small surface roughness Ra, crystals which have grown specifically based on foreign substances, flaws on the base material, and the like during the film formation are left without being grinded due to a difference in hardness between the crystals and their peripheries. In order to avoid this, in the present invention, microscopic observation or the like is made, for example, so as to find out a protrusion having a width and a height of not less than the predetermined values. Then, the protrusion thus found is grinded locally, so that the width and the height are made smaller than the predetermined values (finish grinding). This is also true of the surface of a thin film formed by PVD which is less likely to cause large roughness. Due to particles which have grown specifically on the surface of the film, the surface needs to be grinded as in the case of CVD.

The method of local grinding is not limited particularly. Examples thereof include mechanical grinding using a grinding stone, and removal of only specific crystals using a high-energy beam such as a pulse laser.

In the present invention, the jig for metal plastic working that has the above-described working surface is used as a tool for use in plastic working in which the working surface is moved relatively in contact with the workpiece surface. Examples of the plastic working include drawing, ironing, wire drawing, and the like. In particular, the jig or the present invention is used preferably as an ironing die for use in plastic working in which a high surface pressure is applied between the working surface and the workpiece surface.

In the present invention, the material of the workpiece may be any of various kinds of metals or alloys, and is not limited particularly. Examples thereof may include: aluminum, copper, iron, an allo containing these metals, a tin-plated steel sheet like a tin plate, a surface-treated steel sheet such as an aluminum plate subjected to a chemical conversion treatment, and a pre-coated metal sheet at least one surface of which has an organic coating of polyester or the like.

Figures 4A, 4B, 4C:
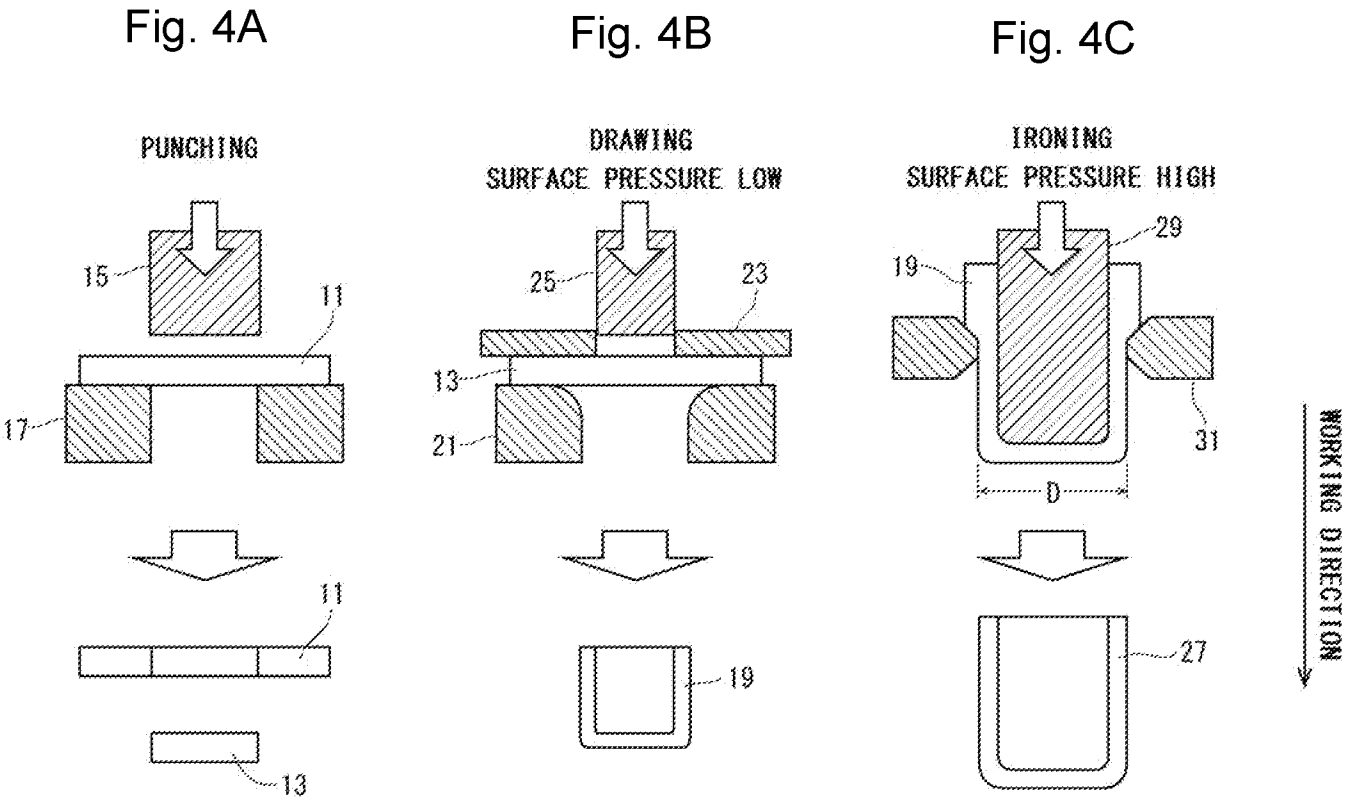
FIGS. 4A-4C depict a diagram showing an example of a press molding process using ironing.

FIGS. 4A-4C show a process of producing a metallic can by press working that uses the jig for metal plastic working of the present invention as an ironing die.

In FIGS. 4A-4C, an element sheet (e.g., an aluminum plate) 11 to be molded into a metallic can is initially subjected to punching, thereby obtaining a circular plate 13 for the metallic can (see, FIG. 4A).

The punching is carried out by using a punch 15 for punching that has an outer diameter equivalent to the diameter of the circular plate 13, and a die 17 that holds the element sheet 11 and has an opening corresponding to the diameter of the circular plate 13. More specifically, when the element sheet 11 held on the die 17 is punched by the punch 15, the circular plate 13 of a predetermined size is obtained.

In accordance with the form of a molded article to be produced by this production process, the element sheet 11 may be punched so that the plate 13 assumes another shape (e.g., a rectangular shape).

The thus-obtained circular plate 13 is subjected to drawing, thereby obtaining a drawn can (bottomed cylindrical body) 19 having a small height (see, FIG. 4B).

During the drawing, the punched circular plate 13 is held on a die 21 with its periphery held by a blank holder jig 23. The die 21 has an opening, into which the circular plate 13 is pressed by a punch 25 for drawing, thereby obtaining the drawn can 19.

At the upper end of the opening of the die 21, a corner (on the side holding the circular plate 13) is rounded (curvature part), so that the circular plate 13 is pressed into the opening of the die 21 rapidly without being broken. The outer diameter of the punch 25 is set to be smaller than the diameter of the opening of the die 21 by an amount corresponding nearly to the thickness of the circular plate 13. Namely, this drawing scarcely involves a thinning process. The drawing may be carried out for a plurality of times depending on the shape of a molded product.

Then, the thus-obtained drawn can 19 is subjected to ironing, resulting in a metallic can base body (drawn and ironed can) 27 having a larger height and a smaller thickness (see, FIG. 4C).

This ironing is carried out in the following manner. A punch 29 for ironing is inserted into the inside of the drawn can 19 obtained by the above-described drawing, and then is lowered allowing the outer surface of the cylindrical body 19 to be pressure-welded to the inner surface of an annular ironing die 31, whereby the side wall of the cylindrical body 19 becomes thinner by the die 31. Consequently, the metallic can base body 27 is obtained that becomes thinner and has a height increased in accordance with the degree of the thinning.

As can be understood in FIGS. 4A-4C, in the series of processes of punching, drawing and ironing, slidability is not required during the punching, while slidability between the die used and the workpiece becomes more necessary as the process proceeds from the drawing to the ironing. This is because the working surface of the jig and the workpiece surface are moved relatively under high surface pressure. In particular, the ironing requires the highest slidability since a surface pressure larger than the yield stress of the workpiece is applied.

In the present invention, the jig for metal plastic working that has the smoothed working surface as described above is used as the annular ironing die 31.

Figure 5:
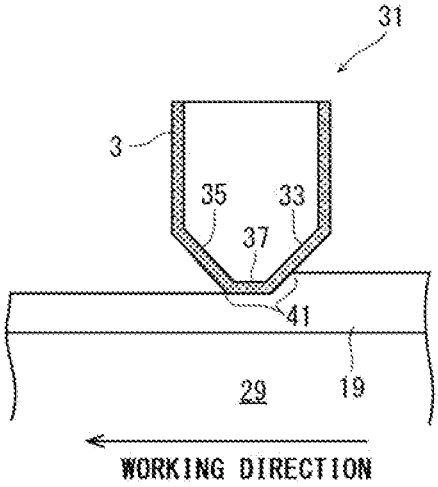
FIG. 5 is a partial side cross-sectional view of an annular ironing die to which the present invention is applied.
Figure 6:
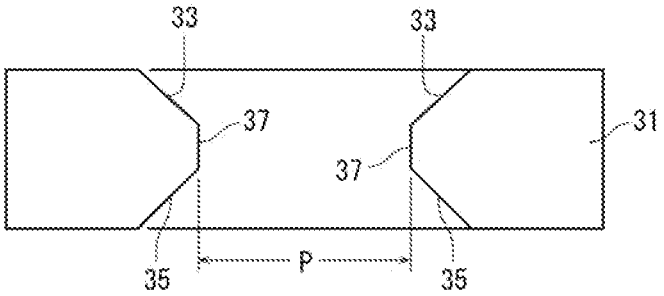
FIG. 6 is an entire side cross-sectional view of the annular ironing die in FIG. 5.

A description will be given of the ironing die 31 with reference to FIGS. 4A-4C (especially, FIG. 4C), FIG. 5 showing a partial cross section of the die 31 as well as the drawn can 19 as a workpiece, and FIG. 6 showing a side cross-sectional view of the die 31. The ironing die 31 includes an inclined surface 33 located upstream of the ironing working direction of the drawn can (workpiece) 19, an inclined surface 35 located downstream of the ironing working direction, and a flat surface 37 located therebetween. A region to be brought into contact with the workpiece 19 serves as a working surface 41. The above-described surface treatment film 3 is formed on the entire surface including these surfaces 33, 35 and 37.

In the ironing die 31 shown in FIGS. 4 to 6, the working surface 41 is formed in an inner annular surface (a region where the inclined surface 33, the flat surface 37 and the inclined surface 35 are present) including the flat surface 37 (this part is also referred to as a land). The surface treatment film 3 may be formed at least on the working surface 41 (i.e., the surface to which a surface pressure is applied during the ironing). Preferably, both ends of the surface treatment film 3 are located away from the working surface 41, so that the film is reliably prevented from peeling off during the tough ironing. In view of this, it is usually most suitable that the carbon film 3 is formed on the entire annular surface, particularly the entire surface of the rigid base material 1 (excluding the top surface in FIGS. 4A-4C). With the carbon film 3, at least the working surface 41 is smoothed to meet the above-described conditions.

While not shown in the figures, it is preferable that a cooling pipe or the like is provided through the inside or the rigid base material 1 so as to suppress a rise in temperature of the working surface 41 during the ironing.

While the single annular ironing die 31 is placed in the example shown in FIGS. 4A-4C, a plurality of the annular ironing dies 31 may be placed at suitable intervals along the working direction. In this case, the die 31 placed downstream of the working direction has a smaller void D, allowing the drawn can 19 to gradually become thinner.

In the present invention, the ironing using the ironing die 31 as described above may be carried out in an environment of liquid (coolant) including water and a lubricant agent, which is called wet working, or alternatively may be carried out without using a coolant, which is called dry working. In the case of dry working, the oil film thickness during molding is smaller than that in wet working, so that transferability of the die surface to the workpiece is improved, resulting in higher mirror surface properties. However, dry working not only reduces the limiting ironing rate but also requires a cooling device for suppressing a rise in temperature of the working surface as mentioned above. On this account, wet working is preferable as an embodiment.

In the present invention, the ironing using the ironing die 31 as described above is also applicable to various kinds of metal or alloy materials as described above. Examples thereof include: aluminum, copper, iron, an alloy containing these metals, a tin-plated steel sheet like a tin plate, a surface-treated steel sheet such as an aluminum plate subjected to a chemical conversion treatment, and a pre-coated metal sheet at least one surface of which has an organic coating. Tough ironing with a high ironing rate can be carried out repeatedly.

In particular, the ironing using the annular ironing die 31 can be carried out preferably to produce a metallic can base body by the process of FIGS. 4A-4C as described above, and most preferably to produce an aluminum can.

EXAMPLES

The present invention will be described by way of the following examples.

In the following examples, the surface roughness was obtained by measuring the arithmetic mean surface roughness Ra by using a surface roughness measuring instrument manufactured by TOKYO SEIMITSU CO., LTD. (SURFCOM 2000SD3) in conformity with JIS-B-0601.

Example 1

An aluminum plate was subjected to ironing by using a die having a width and a maximum height shown in Table 1 and having a diamond coating on its surface. The aluminum plate for use in molding tests was obtained as follows: a material. A3004 was rolled to a plate thickness of 0.29 mm; and the thus-obtained plate was subjected to punching and then drawing to be molded into a bottomed cylindrical body having a diameter φ of 95 mm.

Molding tests were performed in the following manner. Initially, drawing was carried out by moving a punch having an outer diameter φ of 66 mm at a speed of 200 spm to obtain a cylindrical body having a diameter φ of 66 mm, followed by three times of ironing. During the ironing, a coolant emulsion was ejected from each of the ironing dies, so that molding was carried out in a wet environment to obtain a molded can. Further, protrusions on the die were measured with a laser microscope to obtain a cross-sectional shape of each of the protrusions. On the basis of the thus-obtained cross-sectional shape and the position of the protrusion on the die, the shape of a projection along the working direction was calculated for comparison with a flaw on the molded can. The flaw on the can was measured with a white interferometer. At this time, the presence or absence of linear flaws was observed visually. The results are shown in Table 1.

TABLE 1

| | Projected protrusion | | Can barrel flaw | | Presence/absence of linear flaw |
|---|---|---|---|---|---|
| | Width | Maximum height | Width | Maximum depth | (visual observation) |
| Ex. 1-1 | 155 μm | 8.4 μm | 155 μm | 0.30 μm | ○ |
| Ex. 1-2 | 90 μm | 9.2 μm | 85 μm | 0.86 μm | ○ |

TABLE 1-continued

| | Projected protrusion | | Can barrel flaw | | Presence/absence of linear flaw |
|---|---|---|---|---|---|
| | Width | Maximum height | Width | Maximum depth | (visual observation) |
| Ex. 1-3 | 5 μm | 9.0 μm | 5 μm | 0.92 μm | ○ |
| Ex. 1-4 | 10 μm | 7.7 μm | 10 μm | 0.13 μm | ○ |
| Ex. 1-5 | 200 μm | 8.0 μm | 200 μm | 0.14 μm | x |
| Ex. 1-6 | 40 μm | 10.3 μm | 30 μm | 1.0 μm | x |
| Ex. 1-7 | 220 μm | 11.0 μm | 210 μm | 1.3 μm | x |

Table 1 selectively shows only characteristic results. A comparison between the shapes of a projected protrusion and a can barrel flaw shows that their widths are almost equal to each other and that a flaw having a width of 200 μm or more can be observed visually. It is shown that the depth of the can barrel flaw is smaller than the height of the protrusion on the die due to the use of the coolant, while the flaw having a depth of larger than 1.0 μm can be observed visually; the height of the protrusion at this time is about 10 μm.

Example 2

A molded can having a diameter φ of 66 mm was obtained in the same manner as in Example 1. At this time, as shown in Table 2, the arithmetic mean surface roughness Ra of the ironing die was varied to determine whether or not molding was carried out successfully and to observe the appearance of the can. The results are shown in Table 2. In Example 2, no consideration is given to the linear flaw formed by the projected protrusion on the surface of the die as shown in Example 1.

TABLE 2

| | Surface roughness Ra | Result |
|---|---|---|
| Ex. 2-1 | 0.20 μm | X Unsuccessful molding |
| Ex. 2-2 | 0.14 μm | X Unsuccessful molding |
| Ex. 2-3 | 0.12 μm | ○ Flaw formed |
| Ex. 2-4 | 0.10 μm | ○ Flaw formed |
| Ex. 2-5 | 0.08 μm | ◎ Mirror surface |
| Ex. 2-6 | 0.05 μm | ◎ Mirror surface |

The results in Table 2 show as follows. In order to successfully carry out working in a wet environment so as to obtain a can body, the surface of the die needs to be smoothed to have a surface roughness Ra of not more than 0.12 μm, and more preferably not more than 0.08 μm so as to achieve higher mirror surface properties to improve the value of appearance.

The above-described examples show as follows. During plastic working in which a working surface is moved relatively in contact with a metal or alloy workpiece, in order to effectively prevent flaws that extend linearly along the working direction from being formed on the surface of a product, it is desirable that the working surface be smoothed so that the arithmetic mean surface roughness Ra is not more than 0.12 μm and so that no protrusion is observed that has a width of not less than 200 μm and a height of not less than 10 μm, which are calculated on the basis of its projection along the working direction.

The present invention is not limited to the above-described embodiments and examples, and various modifications may be made without departing from the spirit and scope of the present invention.

EXPLANATIONS OF LETTERS OR NUMERALS

1: rigid base material

3: carbon film

19: workpiece (cylindrical body)

31: ironing die

41: working surface

The invention claimed is:

1. An ironing die, comprising:

a working surface configured for contact with a metal or alloy workpiece, wherein the working surface is formed with a hard surface treatment film, the working surface has an arithmetic mean surface roughness Ra that is not more than 0.12 μm, and a protrusion observed in a projection of the working surface along a working direction has a width of less than 200 μm and a height of less than 10 μm.

2. The ironing die according to claim 1, wherein the hard surface treatment film is a carbon film.

3. The ironing die according to claim 1, wherein the hard surface treatment film is a polycrystalline diamond film.

4. The ironing die according to claim 1, wherein having a ring shape with an inner annular surface serving the working surface.

* * * * *